US007350683B2

(12) United States Patent
Meyer

(10) Patent No.: US 7,350,683 B2
(45) Date of Patent: Apr. 1, 2008

(54) FLEXIBLE ROD SUPPORT MEMBER FOR PACKS, BAGS AND OTHER ARTICLES

(75) Inventor: Dean E. Meyer, Oakbrook, IL (US)

(73) Assignee: Meyer Design Group, Inc., Oakbrook, IL (US)

( * ) Notice: Subject to any disclaimer, the term of this patent is extended or adjusted under 35 U.S.C. 154(b) by 274 days.

(21) Appl. No.: 10/767,482

(22) Filed: Jan. 28, 2004

(65) Prior Publication Data

US 2004/0262357 A1 Dec. 30, 2004

Related U.S. Application Data

(63) Continuation-in-part of application No. 10/706,259, filed on Nov. 12, 2003, and a continuation-in-part of application No. 10/610,058, filed on Jun. 30, 2003.

(51) Int. Cl.
*A63B 55/00* (2006.01)
*A45F 3/04* (2006.01)

(52) U.S. Cl. ..... 224/628; 224/576; 224/637; 224/262

(58) Field of Classification Search ..... 224/262, 224/625, 628, 630, 634, 637, 640, 641, 662, 224/664, 665, 671, 677; 206/315.3
See application file for complete search history.

(56) References Cited

U.S. PATENT DOCUMENTS 2,820,498 A * 1/1958 Endee ..... 224/608
3,581,961 A * 6/1971 Owens ..... 224/262
4,154,381 A * 5/1979 Zufich ..... 224/262
4,214,685 A * 7/1980 Pletz ..... 224/634
4,298,149 A * 11/1981 Gottschalk et al. ..... 224/201
4,303,186 A * 12/1981 Ollinger, IV ..... 224/634
4,361,259 A 11/1982 Chanter
4,479,595 A 10/1984 Opsal
4,676,418 A * 6/1987 Lowe ..... 224/638
4,685,601 A 8/1987 Riddling
4,892,238 A * 1/1990 Pinczowski ..... 223/92
5,348,205 A * 9/1994 Steurer ..... 224/627
5,419,473 A * 5/1995 Lamar ..... 224/632
5,429,287 A * 7/1995 Frano ..... 224/640
5,487,498 A 1/1996 Gleason
5,820,141 A 10/1998 Wilkerson et al.
5,836,489 A * 11/1998 Swetish ..... 224/262
5,890,640 A * 4/1999 Thompson ..... 224/630

(Continued)

FOREIGN PATENT DOCUMENTS

BE 1005935 A6 * 3/1994

*Primary Examiner*—Nathan J. Newhouse
*Assistant Examiner*—Justin M. Larson

(57) ABSTRACT

A support member for packs, bags and other articles adapted to be supported from the shoulders of an individual. The support member defines a pair of arms adapted to engage the waist and/or hips of the individual and being made of flexible material, such as a flexible core material, which allows the arms to be manipulated into a selected position against the waist and/or hips of the individual and further adapted to retain such position when the arms are released. In one embodiment, the support member is located within the interior of a back pack and the arms protrude through sleeves integral with the back pack. In another embodiment, the support member is adapted to hang from the handle of a golf bag.

10 Claims, 6 Drawing Sheets

U.S. PATENT DOCUMENTS 5,984,157 A * 11/1999 Swetish ..... 224/631
5,996,871 A 12/1999 Maeng
6,006,974 A * 12/1999 Varney et al. ..... 224/645
6,024,265 A * 2/2000 Clements ..... 224/630
6,182,874 B1 2/2001 Feldman, Jr.
6,199,732 B1 * 3/2001 Swetish ..... 224/262
6,276,584 B1 * 8/2001 McLachlan ..... 224/637
6,607,108 B2 * 8/2003 Mydans ..... 224/630
6,840,419 B2 * 1/2005 Penny et al. ..... 224/637
6,886,727 B2 * 5/2005 Moore ..... 224/637

* cited by examiner

Fig. 1
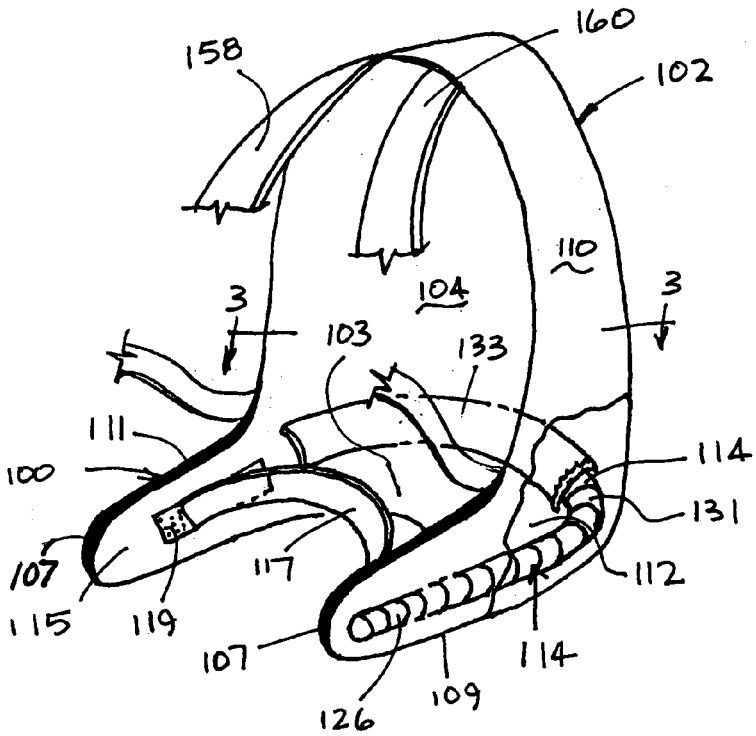
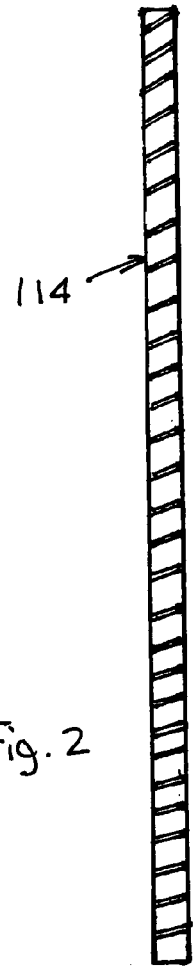
Fig. 2
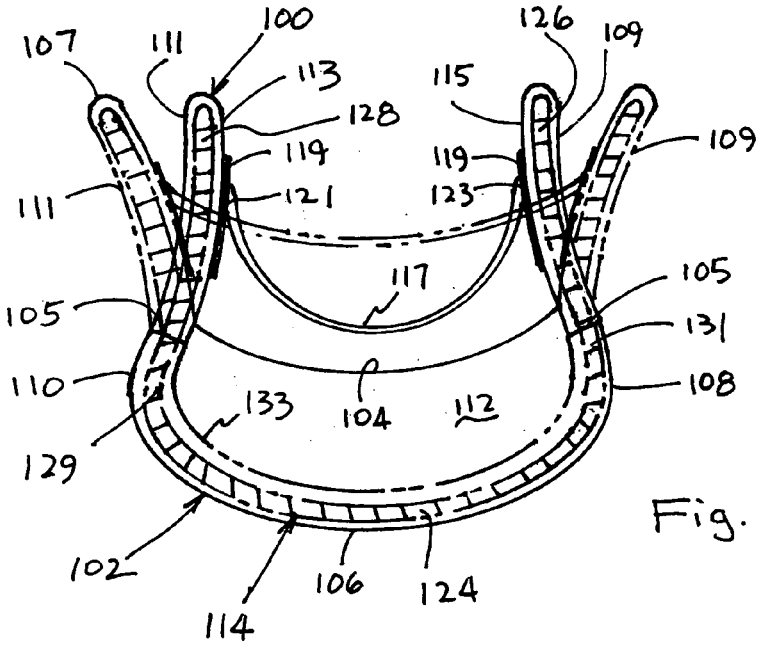
Fig. 3

FLEXIBLE ROD SUPPORT MEMBER FOR PACKS, BAGS AND OTHER ARTICLES

RELATED APPLICATIONS

This application is a continuation-in-part application of U.S. patent application Ser. No. 10/610,058 filed on Jun. 30, 2003 and U.S. patent application Ser. No. 10/706,259 filed on Nov. 12, 2003, both of which are incorporated herein by reference.

FIELD OF THE INVENTION

This invention relates generally to packs, bags and other articles adapted to be suspended and carried in an over-the-back relationship and, more particularly, to a flexible rod member for supporting such packs, bags and other articles.

BACKGROUND OF THE INVENTION

Packs, bags and other articles which are suspended from the shoulders and mounted to the back of a wearer such as, for example, school back packs, hiking back packs, and golf bags have been in widespread use for many years. Although these articles have proven effective in allowing wearers to carry and support, for example, books, hiking supplies and golf clubs, they disadvantageously have placed wearers at an increased risk of shoulder and back injury due to the considerable weight which is often times carried in these articles. This risk has become a particular concern for grade school children who are increasingly being forced to carry excessive numbers of books and supplies in their back packs in order to keep up with the ever escalating homework requirements. This risk is also a concern for caddies who must carry golf bags weighing more than fifty pounds for more than 7,000 yards during a four hour round of play.

In the past, adjustable flexible belts or harnesses adapted to be wrapped and tied around the waist of a wearer have been used in an attempt to relieve the weight of the pack, bag or other article. These belts and harnesses, however, have been ineffective as a weight transferring device and there thus remains a need for a support member, and packs, bags and other articles incorporating the same, which will effectively transfer the weight from the shoulders and back of the wearer to the waist, hips and/or lower back of the wearer.

SUMMARY OF THE INVENTION

The present invention relates to a member for supporting a pack, bag or other article in an over-the-back relationship about the waist and/or hips of the wearer of the pack, bag or other article where the member defines a pair of arms adapted to engage the waist and/or hips of the wearer and the arms are made of a flexible material, such as a flexible core material, which allows the arms to be manipulated into a selected position against the waist and/or hips of the wearer and which are further adapted to retain such position when released by the wearer.

In one embodiment, the article is a pack which includes a front face and defines an interior and the arms are adapted to extend through respective openings and sleeves defined in the front face of the pack, bag or other article.

In another embodiment, the article is a golf bag which is adapted to be carried in a generally horizontal orientation. The golf bag includes an outer surface and a handle, the support member is adapted to be suspended from the handle of the golf bag, and the arms are manipulable into a flexed engaged position against the waist and/or hips of the wearer. In this embodiment, the member comprises an inner flexible core surrounded by a sleeve which includes a tongue adapted to be wrapped around the handle of the golf bag for securing the member to the golf bag.

In still another embodiment, the article is a golf bag adapted to be carried in a generally vertical orientation. The golf bag includes a front face and the arms of the member extend outwardly from the front face and are manipulable into a flexed engaged position against the waist and/or hips of the wearer.

In accordance with the present invention, the use and incorporation of the waist and hip engaging clip of the present invention into over-the-back packs, bags and other articles reduces the shoulder and upper back stresses and injuries which users of such packs, bags and other articles have experienced by advantageously reconcentrating and redistributing the weight which is normally supported entirely by the shoulders and upper back of the wearer to the waist and hips of the wearer.

Other advantages and features of the present invention will be more readily apparent from the following detailed description of the preferred embodiments of the invention, the accompanying drawings, and the appended claims.

BRIEF DESCRIPTION OF THE DRAWINGS

In the drawings:

FIG. 1 is a perspective view, partially in phantom and broken away, of a back pack incorporating a flexible rod support member of the present invention;

FIG. 2 is a side elevational view of the flexible rod of the present invention;

FIG. 3 is a horizontal cross-sectional view, partly in phantom, of the back pack taken along the plane 3-3 in FIG. 1;

DETAILED DESCRIPTION OF THE PREFERRED EMBODIMENTS

Figure 4:
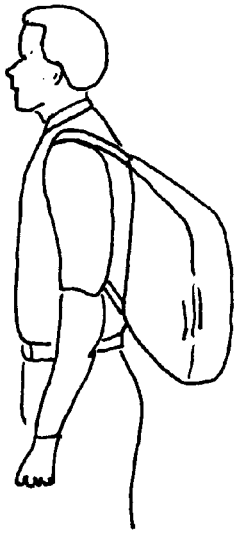
FIG. 4 is a side elevational view of a prior art back pack suspended in an over-the-back relationship from the shoulders of a wearer.

The invention disclosed herein is, of course, susceptible of embodiment in many different forms. Shown in the drawings and described herein below in detail are preferred embodiments of the invention. It is to be understood, however, that the present disclosure is an exemplification of the principles of the invention and does not limit the invention to the illustrated embodiments.

For ease of description, the flexible rod support members of the present invention and the various articles adapted to incorporate the same will be described in a normal (upright) operating position and terms such as upper, lower, horizontal, etc., will be used with reference to this position. It will be understood, however, that the support member and the various bags and articles of the present invention adapted to incorporate the same may be manufactured, stored, transported, used, and sold in an orientation other than the positions shown and described herein.

FIGS. 1-3 depict a flexible rod support member 100 which, in the embodiment shown, is adapted for use with any type of shoulder mounted bag, pack or article such as, for example, the back pack 102 shown in FIGS. 1 and 3 which includes opposed, spaced front and back panels or faces 104 and 106 respectively, opposed and spaced side panels or faces 108 and 110 respectively and a bottom face or panel 112, all together unitarily joined to define a shell defining a hollow interior for carrying and storing books, supplies or the like materials. A lower longitudinal strip 103 of the front panel 104 extending between the side panels 108 and 110 is generally arcuately, concavely shaped so as to correspond generally to the curvature of the small of the back of the wearer of the pack 102 for the purposes to be described in more detail below. Back pack 102 and, more particularly, the panels thereof, may be made from any suitable durable and pliable material including, for example, fabric, vinyl, leather or the like.

Support member 100 initially comprises a pair of elongate, hollow spaced-apart sleeves 109 and 111 extending generally unitarily normally outwardly from the opposed lower corners of the front panel 104 generally adjacent the bottom panel 112 and the front longitudinal vertical edges of the respective side panels 108 and 110. Sleeves 109 and 111 include open proximal ends defining a pair of respective spaced-apart apertures 105 in the panel 104 in communication with the interior of the pack 102 and respective closed distal ends 107 spaced from the open proximal ends and the front panel 104.

In the embodiment of FIGS. 1 and 3, sleeves 109 and 111 are disposed in a generally horizontal, spaced-apart, co-planar relationship. It is understood that sleeves 109 and 111 may be made either unitary with or separate from the pack 102 and from the same or different types of material as the panels of pack 102 suitable for providing a padded or cushioned surface. For example, and although not shown, it is understood that the interior inner facing faces 113 and 115 of the sleeves 109 and 111 respectively may include thickened, foam-like comfort, protective or cushioning pads associated therewith and made from any suitable soft, pliable or deformable cushioning material for the purposes to be described in more detail below.

As shown in FIGS. 1 and 3, an elongate strap 117 extends between and interconnects the sleeves 109 and 111 respectively. A strip 119 of Velcro® hook and loop type or the like material is secured to the inner face of each of the respective sleeves 109 and 111. Strips 119 are adapted to cooperate with like strips (not shown) of Velcro® hook and loop or the like type material associated with the respective ends 121 and 123 of the strap 117 to allow the strap 117 to be removably and adjustably secured to the sleeves 109 and 111.

Figure 6:
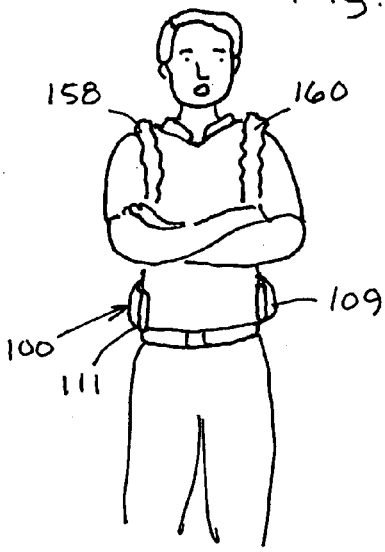
FIG. 6 is a front elevational view of the back pack of FIG. 1 suspended from the shoulders of the wearer with the arms of the flexible rod support member engaged against the waist and hips of the wearer.
Figure 7:
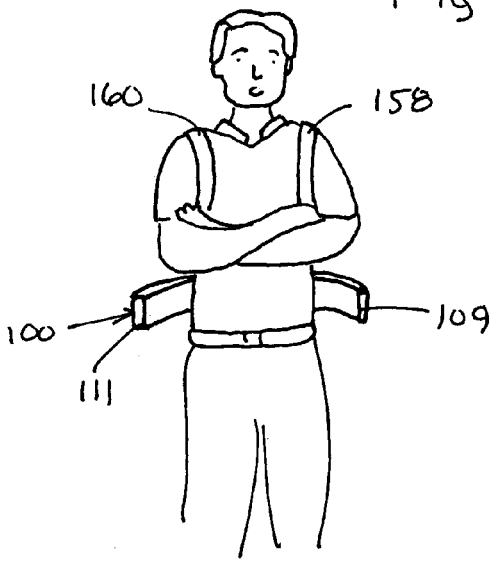
FIG. 7 is a front elevational view similar to FIG. 6 depicting the arms of the flexible rod support member in one of their flexed disengaged positions.

Support member 100 additionally comprises a rod 114 which may be made of any suitable material such as, for example, a flexible core or the like material which allows the rod 114 to be manually manipulated into any one of several positions, configurations and shapes and which is further adapted to retain such position, configuration or shape when the rod 114 is manually released such as, for example, the released disengaged position and configuration of FIG. 7. Particularly, as another example, rod 114 is manipulable and bendable from the straight configuration of FIG. 2 into the configuration of FIGS. 1 and 3 to define a generally "U" or "horseshoe" shaped rod defining a central, generally arcuately shaped base or body portion or segment 124 and a pair of spaced-apart waist and/or hip engaging flexible arms 126 and 128 extending generally horizontally co-planarly outwardly from the respective opposed curved shoulders 129 and 131 of the body 124. As a further example, FIG. 7 depicts the arms 126 and 128 of the rod 114 of the member 100 of the present invention in one of their released disengaged positions while FIG. 6 depicts the arms 126 and 128 after they have been manually flexed and bent inwardly towards each other from the position of FIG. 7 into engagement against the respective sides of the waist and hips of the individual carrying the pack 102. The flexible core or the like structure of the rod 114 of course allows the arms to retain and stay in the FIGS. 6 and 7 positions.

In accordance with the present invention, rod 114 is adapted to be located and secured within the interior of the pack 102 as shown in FIG. 1 in a relationship wherein the body 124, shoulders 129 and 131 and arms 126 and 128 thereof follow the contour of the interior faces of the back and side panels 106, 108 and 110 respectively of the pack 102. Particularly, rod 114 is located within the interior of the pack 102 in a relationship wherein rod 114 is adapted to be seated against or positioned adjacent the inner horizontal surface of the bottom panel 112 of the pack 102, the outer surface of the rod 114 (in the region of the base 124 thereof) is disposed generally adjacent the inner vertical face of the back panel 106 of the pack 102, and the arms 126 and 128 of the rod 114 extend generally longitudinally and horizontally forwardly in the direction of the front panel 104 in a relationship generally adjacent the inner faces of the respective side panels 108 and 110 of the pack 102. The arms 126 and 128 then protrude through the respective opposed apertures 105 defined in the front panel 104 and extend through the length of the interior of the sleeves 109 and 111 respectively.

An elongate strip 133, located within the interior of the pack 102, is adapted to cover at least the base 114 and shoulders 129 and 131 respectively of the rod 114. Stip 133 may be stitched or otherwise suitably secured to the interior faces of the back and bottom panels 106 and 112 respectively of the pack 102.

Figure 5:
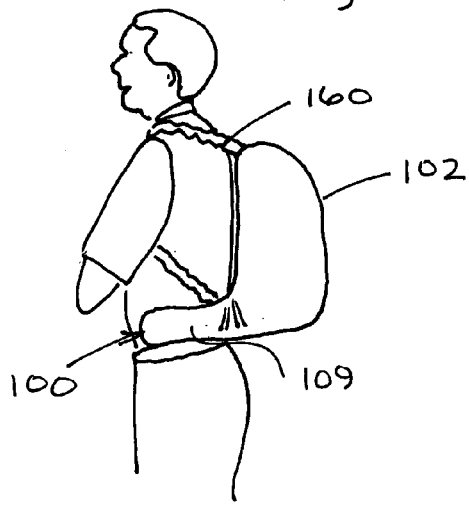
FIG. 5 is a side elevational view of the back pack of FIG. 1 suspended from the shoulders of the wearer in an over-the-back relationship with the arms of the flexible rod support member engaged against respective sides of the waist and hips of the wearer.

As shown in FIGS. 5-7, back pack 102 is adapted to be suspended in an over-the-back relationship from the shoulders of a wearer by means of shoulder straps 158 and 160 in an orientation where the front panel 104 of the pack 102 is disposed adjacent the wearer's back and the lower longitudinal strip 103 thereof is disposed against, and follows the contour of, the small of the wearer's back.

As is well known in the art, the weight of the contents of today's back packs is supported entirely by the pack's shoulder straps which, of course, causes all of the weight of the contents of the pack to be suspended from and concentrated in the shoulders and upper back of the wearer of the pack as shown in FIG. 4 in which the shoulder straps of the prior art pack are shown in their "taut" weight supporting condition. Moreover, the structure of today's packs causes all of the weight of the contents to be located in the bottom of the pack which, of course, causes today's packs to sag as also shown in FIG. 4.

This, of course, places an undue amount of stress on the shoulders and the upper back of the user/wearer of the pack and often results in injuries to the shoulders and back particularly where the weight of the items carried in the bag is disproportionate to the strength of the shoulders and/or back of the user such as, for example, where children are forced to carry and support heavy school books or, as another example, where military personnel carry and support heavy supplies in their packs.

It is also known that the waist and/or hips are better suited than the shoulders and/or upper back from a physical, structural and location standpoint for supporting and/or carrying the weight of a bag or other article in an over-the-back relationship. The present invention advantageously recognizes the increased strength of the waist and/or hips of a user and causes the weight of the pack 102, and the contents stored in the interior thereof, to be transferred and redistributed from the shoulder straps 158 and 160 to the rod 114 and, more particularly, the arms 126 and 128 thereof. This is reflected in FIGS. 5 and 6 where the sleeves 109 and 111 and thus the arms 126 and 128 of the rod 114 therein are shown in their flexed engaged positions against the respective sides of the waist and hips of the wearer and the shoulder straps 158 and 160 are shown in their "slackened" or "loose" weight redistribution condition.

This, of course, advantageously reduces the shoulder and upper back stresses and injuries which users and wearers of standard back packs have experienced. According to the invention, a majority of the weight of the back pack 102 and its contents is thus advantageously reconcentrated and redistributed through the rod 114 from the shoulders and upper back of the wearer to the hips and/or waist and lower back of the wearer. The presence of the rod 114 in the interior of the pack 102 and, more particularly, the positioning thereof along the periphery of the bottom panel 112 thereof also advantageously defines a reinforcing and structural frame which provides rigidity to the bottom panel 112 of the pack 102, thus eliminating sagging of the pack 102.

Moreover, and as shown in FIG. 3, it is understood that the strap 117, by virtue of the positioning and detachable securement thereof between the sleeves 109 and 111, is adapted to cause the sleeves 109 and 111 (and thus the rod arms 126 and 128 therein) to flex and bend laterally inwardly towards each other when a user mounts the pack 102 over his/her back. Stated another way, the mounting of the pack 102 causes the strap 117 to come into abutting relationship with the small of the user's back which, in turn, forces the strap 117 to move generally laterally rearwardly in the direction of the front panel 104 thereof which, in turn, causes the sleeves 109 and 111 and the rod arms 126 and 128 to flex inwardly into compressive engaging action against the waist and/or hips of the wearer. Although not shown, it is also understood that the releasable nature of strap 117 allows a user to manually vary the lateral distance between the strap 117 and the pack 102 which, in turn, allows a user to customize the compressive action created by the sleeves 109 and 111. This compressive action, of course, allows the rod 114 to be firmly and tightly wrapped around the waist and/or hips of the user which, in turn, allows the pack 102 to be firmly and tightly suspended and carried. The compressive action additionally provides for a more efficient transfer of the weight of the contents of the pack 102 from the rod arms 126 and 128 to the waist and/or hips of the user.

Figure 8:
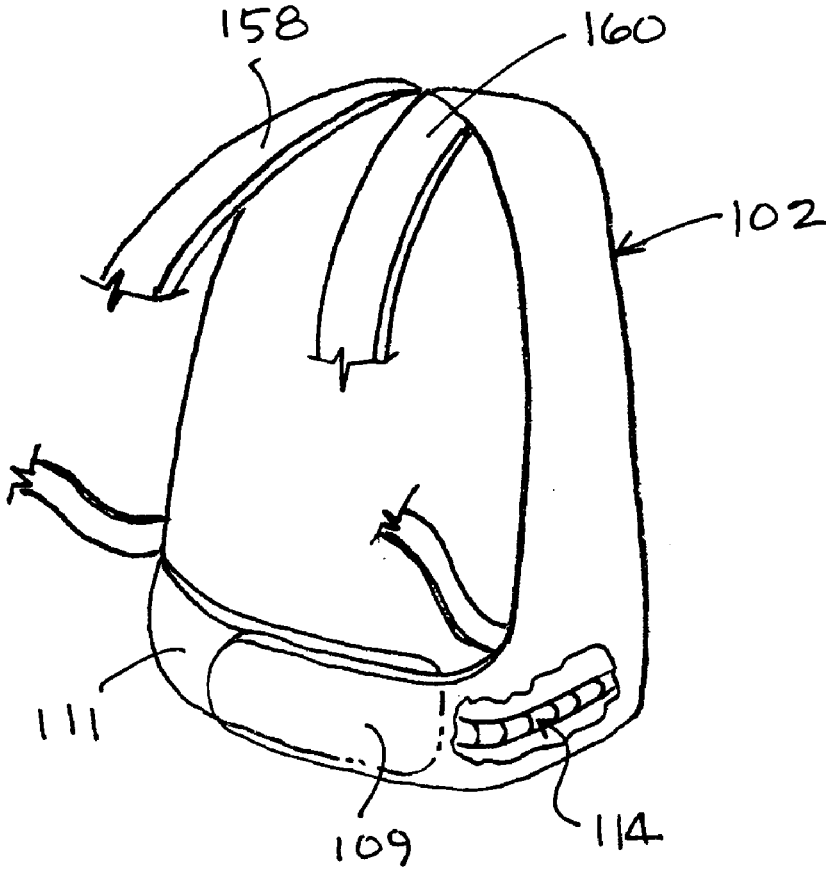
FIG. 8 is a perspective view of the pack shown in FIG. 1 with the sleeves thereof folded against the front face of the pack.

Although not shown, it is understood that the flexible core or the like structure of the rod 114 of support member 100 also offers the additional advantage of providing a pack 102 in which the sleeves 109 and 111 can be folded towards each other in the direction of and flat against the front panel 104 of the pack 102 (as shown in FIG. 8) or back away from each other in the direction of and against the respective side panels 108 and 110 thus advantageously allowing the overall size of the pack 102 to be reduced which, of course, allows the pack 102 to be more easily transported when not in use and also allows the pack 102 to be more easily stored in lockers, closets and the like.

Figure 9:
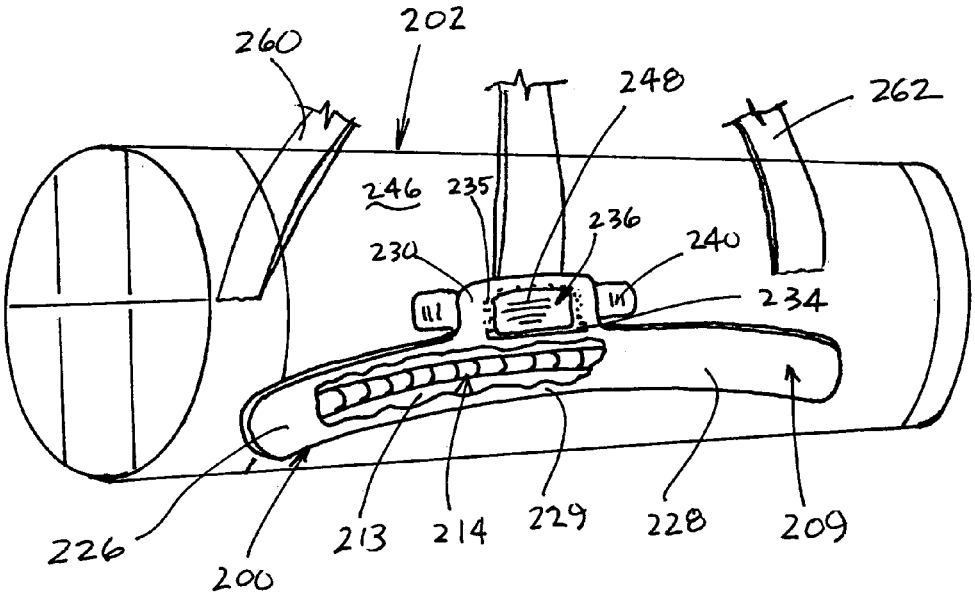
FIG. 9 is a partially broken perspective view of a golf bag incorporating an alternate embodiment of the flexible rod support member of the present invention.
Figure 10:
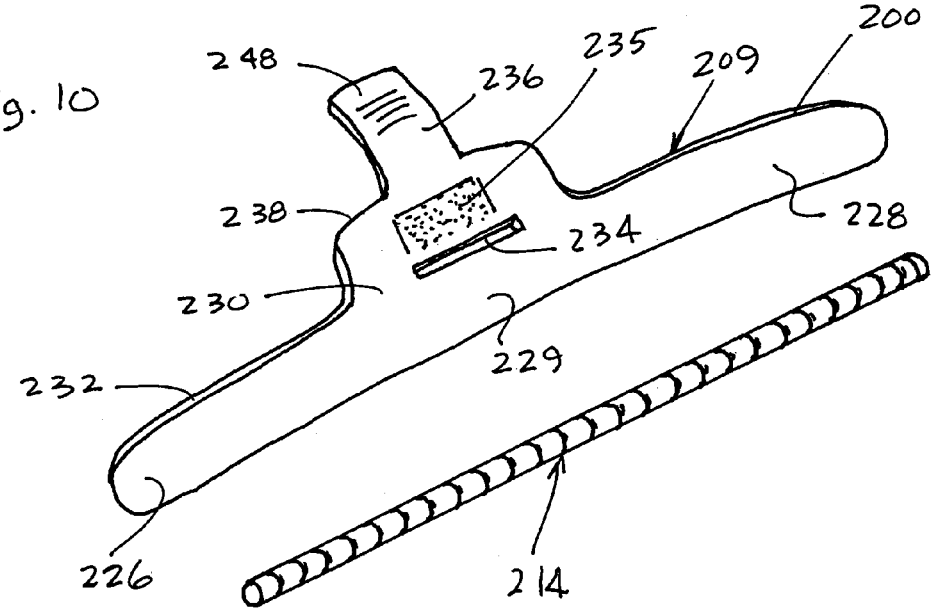
FIG. 10 is an exploded perspective view of the flexible rod support member shown in FIG. 9.
Figure 13:
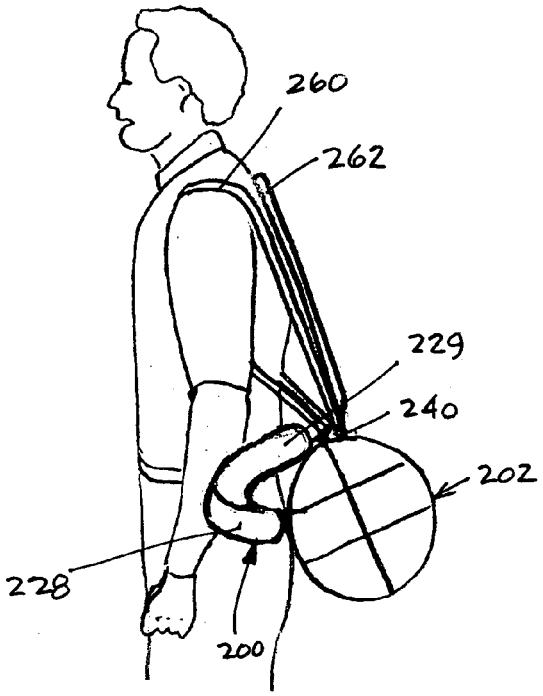
FIG. 13 is a side elevational view depicting the golf bag of FIG. 9 suspended in a generally horizontal over-the-back relationship from the shoulders of an individual carrying the bag with the flexible rod support member in one of its flexed disengaged positions.
Figure 14:
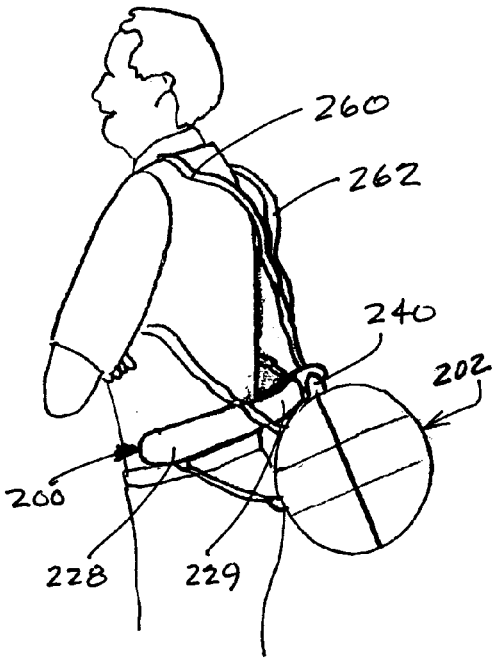
FIG. 14 is a side elevational view similar to FIG. 13 depicting the flexible rod support member in its flexed engaged position against the respective sides of the waist and hips of the individual.

Another flexible support member embodiment 200 is shown in FIGS. 9 and 10 which is adapted to be incorporated for use on a golf bag 202 adapted to be carried in the generally over-the-back horizontal orientation shown in FIGS. 13 and 14.

Support member 200 initially comprises an elongate rod 214 which may be made of the same type of flexible core or the like material as rod 114 described above and thus the description with respect to the structure and features of rod 114 is incorporated herein by reference.

Support member 200 additionally comprises an elongate sleeve 209 which defines a protective housing or cushioning envelope for the rod 214. Sleeve 209 may be made of the same types of material as the sleeves 109 and 111 of the back pack 102. Although not shown, it is understood that sleeve 209 includes a slit or the like formed in one of the distal end portions thereof through which rod 214 is adapted to be fed and extended into and through the hollow interior 213 defined by sleeve 209. Sleeve 209 and thus support member 200 defines a pair of opposed, elongate arms 226 and 228 and a central body portion 229 therebetween and unitary therewith.

Sleeve 209 and thus support member 200 additionally comprises a central neck 230 extending unitarily generally upwardly and outwardly from a top longitudinal edge 232 of sleeve 209 in the region of the body 229. A longitudinal slit 234 is defined in and extends through the neck 230. A strip of Velcro® or the like material 235 is fixed to the outer surface of the neck 230 just above the slit 234. Sleeve 209 and thus support member 200 still further comprises an elongate strap or tongue 236 extending unitarily outwardly and upwardly from a top longitudinal edge 238 of the neck 230. Strap 236 is adapted to allow the support member 200 to be detachably secured to the handle 240 of golf bag 202 as shown in FIG. 9.

More particularly, and referring to FIGS. 9 and 10, strap 236 is adapted to be wrapped first around the top of the handle 240, then back around and through the opening (not shown) defined between the handle 240 and the golf bag outer surface 246. Strap 236 is then fed from under the neck 230 through the slit 234 defined therein. The distal end 248 of strap 236, the underside of which includes a strip of Velcro® or the like material, is then pushed down into abutting relationship with the strip 235 of Velcro® or the like material on the top of neck 230 thus removably and detachably securing the support member 200 to the handle 240 and thus to the golf bag 202.

Support member 200 is adapted to hang down from the handle 240 of the golf bag 202 in a relationship wherein the sleeve 209 extends below the handle 240 in a generally parallel relationship relative to the handle 240 and in a generally longitudinal and extended relationship across the length of the bag 202.

Support member 200, and, more particularly, the arms 226 and 228 of sleeve 209 are adapted to be flexed and bent about the body 229 thereof from the extended positions of FIG. 9 to the position of FIG. 14 where the arms 226 and 228 have been brought together into an engaged relationship against the respective sides of the waist and/or hips of the individual carrying the bag 202. Although not shown in any of the drawings, it is understood that the outer exterior face of the sleeve 209 may be covered with additional protective material to provide a cushion between the waist and/or hips of the person carrying the golf bag 202 and the rod 214 contained within the sleeve 209.

In accordance with the present invention and as described earlier with respect to the rod 114, the flexible core or the like construction of the rod 214 advantageously allows the arms 226 and 228 of sleeve 209 to retain whichever engaged or disengaged position, configuration or shape the arms are manually manipulated into by the user such as, for example, the disengaged position of FIG. 13 where the arms 226 and 228 have simply been bent away from the waist of the user, or the engaged position of FIG. 14 where the arms 226 and 228 have been manually manipulated and bent into and surrounding the respective sides of the waist and hips of the individual carrying the golf bag 202.

In the same manner as rod 114 associated with back pack 102 and thus incorporated herein by reference, rod 214 also advantageously allows for the redistribution of the weight of the bag 202 and the contents thereof from the shoulders and upper back of the individual carrying the bag 202 to the lower back, waist and hips of the individual. This redistribution is reflected and exhibited in FIGS. 13 and 14 which both depict the bag 202 suspended from the individual's shoulders by means of shoulder straps 260 and 262. In the configuration of FIG. 13, the support member 200 is shown in one of its disengaged positions and thus all of the weight of the bag 202 and the contents thereof is supported entirely by the shoulders of the individual carrying the bag 202, as reflected by the "taut" condition of the shoulder straps 260 and 262. However, and as shown in FIG. 14, the engagement of member 200 against the waist and hips of the individual causes the weight of the bag 202 and the contents thereof to be redistributed and re-routed from the straps 260 and 262 and shoulders of the individual to the rod 214 and thus the waist and hips of the individual as reflected by the "loose" condition of the straps 260 and 262 in FIG. 14.

This weight transfer, of course, advantageously reduces the burden which is ordinarily associated with carrying a golf bag during an average eighteen hole round of golf. The member 200 offers a particular significant advantage for caddies who are commissioned or hired to carry the bags of professional golfers at tournaments and the like where the bags can end up weighing more than fifty pounds.

Support member 200 offers the additional advantage of defining a belt which, when engaged against the waist and/or hips of the individual carrying the bag 202 has the effect of stabilizing the bag 202 and minimizing the side-to-side movement of the bag 202 which normally occurs when walking with the bag 202 suspended from the shoulders.

Figure 12:
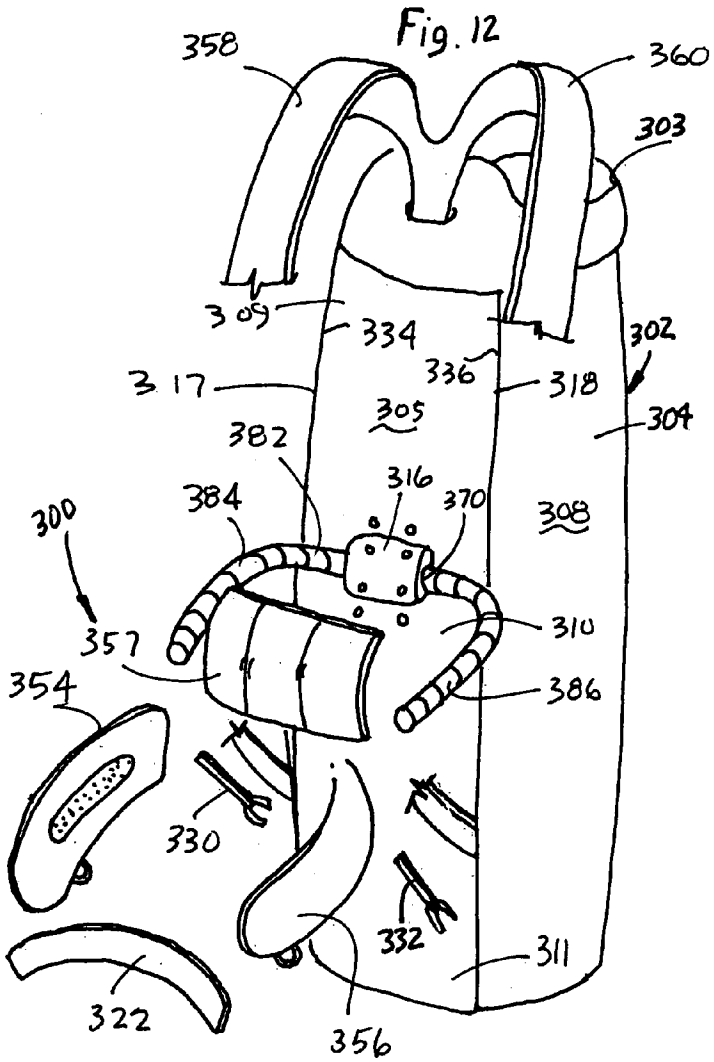
FIG. 12 is an exploded, partially broken, perspective view of the golf bag shown in FIG. 11.
Figure 11:
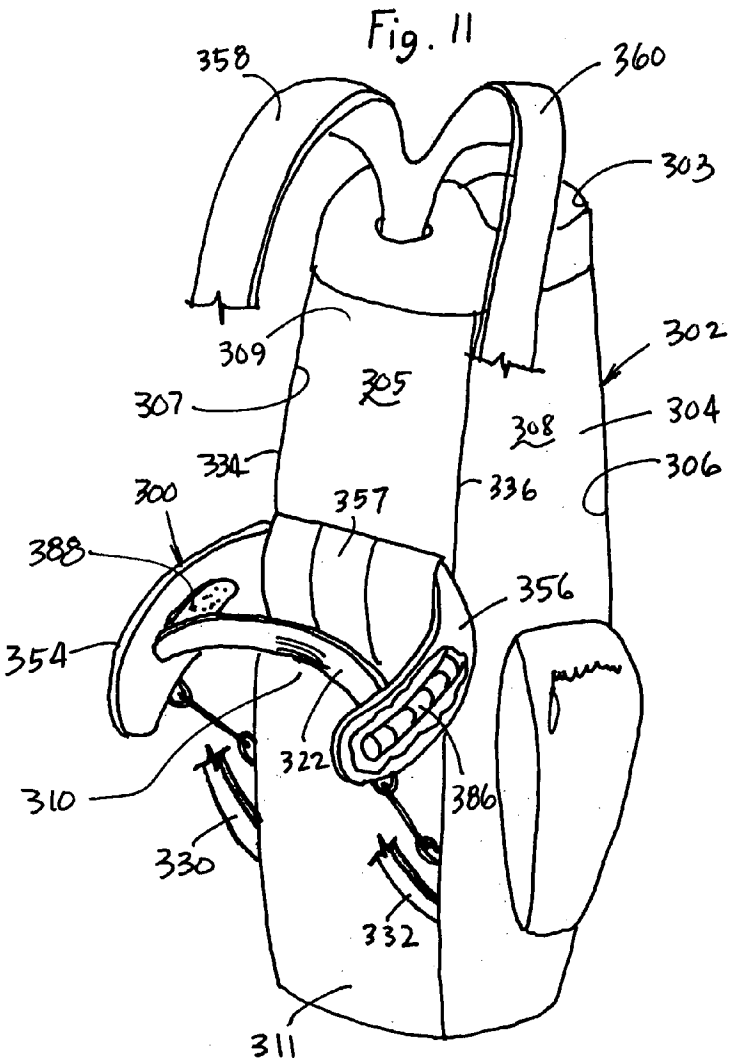
FIG. 11 is a partially broken perspective view of a golf bag incorporating a further embodiment of the flexible rod support member of the present invention.
Figure 15:
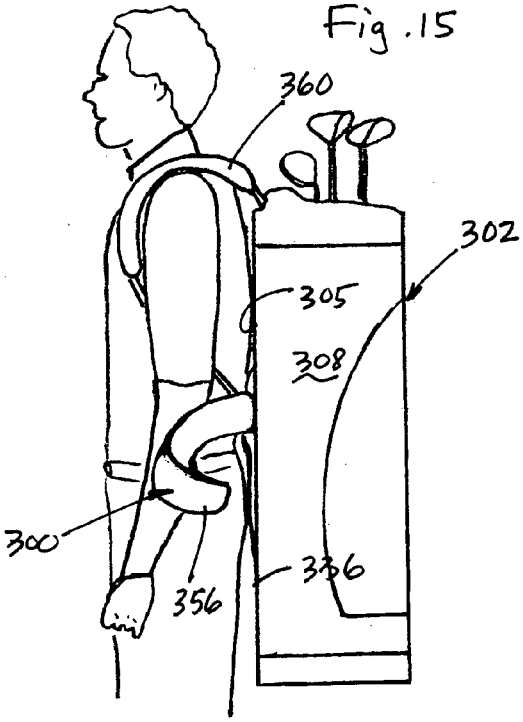
FIG. 15 is a side elevational view depicting the golf bag of FIGS. 11 and 12 suspended in a generally vertical over-the-back relationship from the shoulders of an individual with the flexible rod support member in one of its flexed disengaged positions.
Figure 16:
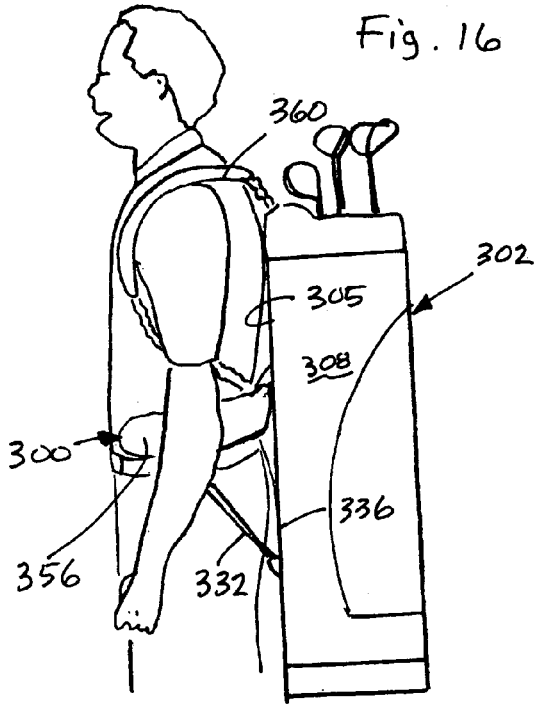
FIG. 16 is a side elevational view similar to FIG. 15 depicting the flexible rod support member in its flexed engaged position against the respective sides of waist and hips of the individual.

FIGS. 11 and 12 depict another support member embodiment 300 adapted to be integrated for use on a golf bag 302 designed to be carried in a generally vertical/up and down over-the-back orientation as shown in FIGS. 15 and 16.

Golf bag 302, in the same manner as golf bag 202, comprises an interior, hollow shell 303 which may be made of any suitable durable, hard material such as plastic or the like and adapted to receive and carry golf clubs. Shell 303 is adapted to be surrounded and covered by an outer protective liner 304 made of any suitable material such as, for example, a cushioned, padded synthetic or fabric material. Bag 302 includes opposed, spaced-apart, and generally parallel front and back longitudinal panels 305 and 306 respectively and opposed, spaced-apart and parallel side longitudinal panels 307 and 308 respectively extending between the front and back panels 305 and 306 in a generally normal relationship thereto. Each of the panels 305, 306, 307 and 308 includes a top or upper open end region 309, a mid-region 310, and a bottom or lower closed end region 311.

Support member 300 initially comprises an elongate bracket or plate 316 extending along the width of the front panel 305 of the bag 302 in the mid-region 310 thereof. Plate 316 may be secured to the surface of front panel 305 of shell 303 of bag 302 using rivets or the like securement means and is seated and disposed on the surface of shell 303 in an orientation generally normal to the opposed longitudinal bag edges 382 and 384 which separate the front panel 305 from the side panels 307 and 308.

An elongate flexible rod 314, which is of the same flexible core or the like construction as the rods 114 and 214 described earlier and thus incorporated herein by reference, is secured to and extends longitudinally through an aperture 370 defined in and extending between the sides of plate 316. FIGS. 11 and 12 depict the rod 314 flexed and bent about the ends of the plate 316 into a generally "U"-shaped configuration and thus defining a central base portion or segment 382 extending in a generally parallel and adjacent relationship across the width of the front panel 305 and plate 316 of bag 302 and a pair of spaced-apart arms 384 and 386 extending unitarily outwardly from the respective ends of the base portion 382 and generally normally outwardly from the front panel 305 end and plate 316 of bag 302 in a horizontally co-planar relationship. It is understood, of course, that the flexible core or the like material or construction of the rod 314 allows the arms 384 and 386 to be bent and distorted into any desired shape, configuration or position, i.e., shapes, configuration and positions which the rod 314 retains after being released.

Support member 300 still further comprises a pair of elongate hollow comfort pads, cushions or sleeves 354 and 356 which are adapted to be slid over the length of the respective arms 384 and 386 respectively. The pads or cushions 354 and 356 may be made of any suitable soft, pliable and/or deformable material. Alternatively, a suitable layer of cushioning material may be applied or molded directly to the surface of the arms 384 and 386 by any know process. A pad or cushion 357 is also adapted to cover the bracket 316 of support member 300.

Support member 300 still further comprises a strap 322 which extends between and interconnects the sleeves 354 and 356 and thus the respective arms 384 and 386 together. Cooperating strips 388 of Velcro® or the like material, similar to those described earlier in connection with the pack 102 and thus incorporated herein by reference, are fixed to the inner faces of the respective sleeves 354 and 356 and the respective ends of the strap 322 for detachably securing the strap 322 to the sleeves 354 and 356.

As shown in FIGS. 15 and 16, golf bag 302 is adapted to be mounted and suspended from the shoulders of an individual by means of shoulder straps 358 and 360 associated and secured to the golf bag 302 in a manner which allows the bag 302 to be carried in the generally over-the-back vertical orientation shown therein.

Support member 300 and, more particularly, the arms 384 and 386 of the rod 314 therein, are adapted to be bent into any of several different flexed positions including the flexed disengaged position of FIG. 15 where the sleeves 354 and 356 and thus the arms 384 and 386 of rod 314 have been bent and flexed away from the body of the individual. Although not shown, it is understood that the sleeves and thus arms 384 and 386 are flexible and bendable rearwardly all the way back against the side panels 307 and 308 of the golf bag 302 to eliminate any interference by the sleeves as desired. In the position of FIG. 16, the sleeves 354 and 356 and thus arms 384 and 386 have been flexed and bent towards each other and into engagement against the respective sides of the wearer's waist and hips. In this position, the sleeves and thus the arms 384 and 386 are positioned in a generally horizontal co-planar orientation generally normal to the front panel 305 of the bag 302. Straps 330 and 332, extending between the respective distal ends of the sleeves 354 and 356 and the longitudinal edges 334 and 336 extending respectively between the front panel 305 and the side panels 306 and 308, are adapted to prevent the sleeves and thus arms 384 and 386 from flexing any further up thus assuring that the arms remain engaged against the waist of the individual.

In accordance with the present invention, and in a manner similar to the earlier flexible rod support member embodiments, the description of which is thus incorporated herein by reference, support member 300 and thus the arms 384 and 386 of the rod 314 are adapted to cause the weight of the bag 302 and the contents thereof to be transferred and redistributed from the shoulders and upper back of the wearer to the lower back, waist and hips of the wearer thus advantageously eliminating the shoulder and upper back stresses which often times lead to shoulder and back injuries. According to the invention, a majority of the weight of the bag 302 and the golf clubs adapted to be carried therein is thus advantageously reconcentrated and redistributed through the support member 300 from the shoulders and upper back of the wearer to the waist, hips and lower back of the wearer.

It will be readily apparent from the foregoing detailed description of the invention and from the illustrations thereof that numerous variations and modifications may be effected without departing from the true spirit and scope of the novel concepts or principles of this invention. It will also be readily apparent that the flexible rod support member of the present invention is applicable not only with back packs and golf bags but also with a variety of other articles which are adapted to be mounted to the back or suspended from the shoulders of a wearer such as, for example, back packs used by military personnel, back mounted vacuum cleaners, back mounted leaf blowers, and baby carriers.

I claim:

1. A pack adapted to be carried by an individual in an over-the-back relationship and comprising a single member for supporting the pack about the waist and/or hips of the individual carrying the pack, the pack defining a hollow interior and including a front panel defining an outer surface and a bottom panel, the member being defined by a continuous strip of material which has been bent and shaped to define a base and a pair of arms, wherein said base is located within the interior of the pack and extends along the bottom panel of the pack in a generally horizontal and parallel relationship relative to the bottom panel and wherein said arms extend through respective openings defined in the pack and in a direction generally normal to the front panel, wherein the pair of arms are adapted to engage the waist and/or hips of the individual carrying the pack and are made of a flexible material which allows the shape of said arms to be changed along the length thereof so as to allow said arms to be manipulated by the individual carrying the pack into at least a first selected bent and curved position against the waist and/or hips of the individual carrying the pack, wherein said flexible material of said arms allows said arms to independently retain said at least first selected bent and curved position when said arms are released by the individual carrying the pack.

2. The pack of claim 1 wherein a strap is adapted to engage against the back of the individual adapted to carry the pack and interconnects the arms and is adapted to move the arms towards each other when the pack, is mounted over and the strap engages the back of the individual.

3. A pack adapted to be suspended from the shoulders of a wearer, the pack including a shell defining a hollow interior, a front face having a pair of openings defined therein, a bottom panel, and a pair of sleeves extending outwardly from the front face thereof in the region of said openings defined therein, the pack further comprising a support member defining an elongated flexible rod located within the interior of the pack and extending along the bottom panel of the pack in a generally U-shaped configuration and defining a pair of arms extending through the shell and said pair of sleeves defined in said pack respectively and adapted to engage the waist and/or hips of the wearer, the arms being made of a flexible material allowing the arms to be manipulated into a selected position about the waist and/or hips of the wearer and further adapted to retain said manipulated position when released by the wearer.

4. The pack of claim 3 wherein a strap interconnects and extends between said arms, said strap being adapted to engage against the back of the wearer and bring said arms together into engagement against the waist and/or hips of the wearer.

5. The pack of claim 3 wherein the rod is made of a flexible core material.

6. A back pack adapted to be carried by an individual and defining an outer surface, a bottom panel, opposed side panels, a front panel, a pair of sleeves protruding outwardly from the front panel thereof, a hollow interior and straps for suspending the back pack in an over-the-back relationship, the back pack including a generally U-shaped support member extending through the interior of said back pack along the bottom panel and defining a pair of manipulable arms extending outwardly from said front panel of said back pack and into said sleeves thereof, said arms being made of a flexible material allowing the support member to be manipulated into a selected position and shape about the waist and/or hips of the individual and further adapted to retain said manipulated position and shape when released by the individual.

7. The back pack of claim 6 wherein a strap interconnects and extends between said arms, said strap being adapted to abut against the back of the individual and bring said arms together.

8. A member for supporting a golf bag adapted to be carried in a generally horizontal relationship about the waist and/or hips of a wearer of the golf bag , the golf bag including an outer surface and a handle, the member being adapted to be suspended from the handle of the golf bag and defining a pair of arms adapted to engage the waist and/or hips of the wearer and being made of a flexible material allowing said arms to be manipulated into a flexed position against the waist and/or hips of the wearer and further adapted to retain said position when released by the wearer, the member further comprising an elongate flexible core surrounded by a sleeve including a tongue adapted to be wrapped around the handle of the golf bag for securing the member to the golf bag.

9. A golf bag defining an outer surface and adapted to be carried in a generally horizontal over-the-back orientation, the golf bag including a support member defining a pair of arms extending away from the outer surface of the golf bag and being made of a flexible material allowing the support member to be manipulated into a flexed position and shape about the waist and/or hips of the individual carrying the golf bag and further adapted to retain said manipulated position and shape when released by the individual, the arms further comprising an elongate flexible core surrounded by a sleeve including a tongue adapted to be wrapped around a handle on the golf bag.

10. A golf bag defining a front face and adapted to be carried in a generally vertical over-the-back orientation, the golf bag including a support member defining a pair of arms extending outwardly from the front face of the golf bag and being made of a flexible material allowing the support member to be manipulated into a selected flexed position and shape against the waist and/or hips of the individual carrying the golf bag, the golf bag further comprising a strap interconnecting the arms of the support member and adapted to engage against the back of the individual carrying the golf bag and bring said arms together when the golf bag is mounted over the back of the individual, the golf bag still further comprising a pair of straps extending between the ends of the arms respectively and the outer surface of the golf bag, said straps being adapted to restrict the upward movement of said arms relative to the outer surface of the golf bag.

* * * * *